US008227162B2

(12) United States Patent
Sano et al.

(10) Patent No.: US 8,227,162 B2
(45) Date of Patent: Jul. 24, 2012

(54) MAGNETIC TONER

(75) Inventors: Tomohisa Sano, Suntou-gun (JP); Michihisa Magome, Mishima (JP); Takashi Matsui, Suntou-gun (JP); Akira Sakakibara, Susono (JP); Shuichi Hiroko, Susono (JP); Yoshitaka Suzumura, Mishima (JP); Shotaro Nomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/754,918

(22) Filed: Apr. 6, 2010

(65) Prior Publication Data

US 2010/0266943 A1 Oct. 21, 2010

(30) Foreign Application Priority Data

Apr. 15, 2009 (JP) ..... 2009-099253

(51) Int. Cl.
*G03G 9/00* (2006.01)

(52) U.S. Cl. ..... 430/108.3; 430/106.1

(58) Field of Classification Search ..... 430/108.3, 430/106.1

See application file for complete search history.

(56) References Cited

U.S. PATENT DOCUMENTS

| | | | | |
|---|---|---|---|---|
| 4,620,987 | A | 11/1986 | Yamashita et al. | |
| 5,118,587 | A | 6/1992 | Takaragi et al. | |
| 5,948,582 | A | 9/1999 | Nakamura et al. | 430/110 |
| 6,051,350 | A | 4/2000 | Inaba et al. | 430/45 |
| 6,077,635 | A | 6/2000 | Okado et al. | 430/45 |
| 6,077,636 | A | 6/2000 | Moriki et al. | 430/45 |
| 6,183,927 | B1 | 2/2001 | Magome et al. | 430/110 |
| 6,287,739 | B1 | 9/2001 | Kawakami et al. | 430/108.7 |
| 6,447,968 | B1 * | 9/2002 | Ohno | 430/106.2 |
| 6,447,969 | B1 | 9/2002 | Ito et al. | 430/106.2 |
| 6,465,144 | B1 | 10/2002 | Hashimoto et al. | 430/106.1 |
| 6,544,708 | B2 | 4/2003 | Komoto et al. | 430/124 |
| 6,596,452 | B2 | 7/2003 | Magome et al. | 430/106.2 |
| 6,638,674 | B2 | 10/2003 | Komoto et al. | 430/106.1 |
| 6,653,035 | B2 | 11/2003 | Komoto et al. | 430/106.1 |

(Continued)

FOREIGN PATENT DOCUMENTS

EP 1 515 194 A2 3/2005

(Continued)

OTHER PUBLICATIONS

Search Report dated Aug. 18, 2010 in European Application No. 10003798.5.

*Primary Examiner* — Mark A Chapman

(74) *Attorney, Agent, or Firm* — Fitzpatrick, Cella, Harper & Scinto

(57) ABSTRACT

To provide a toner excellent in low-temperature fixability, releasing performance, and development stability in long-term use under a high-temperature and high-humidity environment, provided is a magnetic toner including: magnetic toner particles each containing at least a binder resin and a magnetic particles; and an inorganic fine powder, in which: the magnetic particles is a treated magnetic particles treated with a silane compound; the treated magnetic particles has a water adsorption per unit area based on a BET specific surface area of 0.300 mg/m$^2$ or less; portion of styrene extractables constitutes 25 mass % or less among the silane compound in the treated magnetic particles; and the silane compound with which the treated magnetic particles is treated contains a compound having a hydrocarbon group having 2 or more and 4 or less carbon atoms as a main component.

9 Claims, 3 Drawing Sheets

U.S. PATENT DOCUMENTS

| | | | | |
|---|---|---|---|---|
| 6,916,586 | B2 | 7/2005 | Ishiyama et al. | |
| 7,043,175 | B2 | 5/2006 | Komoto et al. | 399/159 |
| 7,123,862 | B2 | 10/2006 | Hasegawa et al. | 399/223 |
| 7,361,442 | B2 | 4/2008 | Otake et al. | 430/122.5 |
| 7,371,494 | B2 | 5/2008 | Chiba et al. | 430/106.2 |
| 7,452,649 | B2 | 11/2008 | Magome et al. | 430/111.3 |
| 7,537,877 | B2 | 5/2009 | Yoshiba et al. | 430/108.6 |
| 7,582,401 | B2 | 9/2009 | Ogawa et al. | 430/109.3 |
| 7,638,251 | B2 | 12/2009 | Yamazaki et al. | 430/109.3 |
| 7,678,523 | B2 | 3/2010 | Hiroko et al. | 430/111.4 |
| 7,678,524 | B2 | 3/2010 | Hasegawa et al. | 430/111.41 |
| 2006/0057483 | A1 | 3/2006 | Yanase et al. | 430/108.4 |
| 2006/0188800 | A1 | 8/2006 | Magome et al. | 430/106.1 |
| 2007/0026336 | A1 | 2/2007 | Yamazaki et al. | 430/109.3 |
| 2007/0072102 | A1 | 3/2007 | Dojo et al. | 430/106.1 |
| 2007/0105033 | A1 | 5/2007 | Moribe et al. | 430/109.3 |
| 2009/0047043 | A1 | 2/2009 | Dojo et al. | 399/252 |
| 2009/0117477 | A1 | 5/2009 | Magome et al. | 430/48 |
| 2009/0130580 | A1 | 5/2009 | Dojo et al. | 430/106.1 |
| 2009/0197192 | A1 | 8/2009 | Hiroko et al. | 430/106.2 |
| 2010/0009277 | A1 | 1/2010 | Ogawa et al. | 430/108.7 |
| 2010/0028795 | A1 | 2/2010 | Magome et al. | 430/108.4 |

FOREIGN PATENT DOCUMENTS

| | | |
|---|---|---|
| JP | 58-7646 | 1/1983 |
| JP | 2000-327948 | 11/2000 |
| JP | 2004-294480 | 10/2004 |

* cited by examiner

β : total peak area derived from alcoxysilane, alcoxysilane hydrolysate and siloxane
γ : peak area derived from siloxane Schematic chart of $^{1}$H-NMR of alcoxysilane A: Peak derived from alcoxy group B: Peak derived from alkylalcohol

MAGNETIC TONER

BACKGROUND OF THE INVENTION

1. Field of the Invention

The present invention relates to a magnetic toner for use in a recording method involving the utilization of an electrophotographic method or the like.

2. Description of the Related Art

When the processing speed of an image-forming method based on a jumping method involving the use of a magnetic toner is increased, it becomes difficult to maintain stable image density or image quality. This is caused by the ease of a temperature rise in apparatus or by the insufficient fixing time, both due to the increased processing speed. In addition, the instability is caused by the following situation as well. That is, a rubbing between a cleaning member and the surface of an electrostatic latent image-bearing member intensifies, and hence the stability of a cleaning mechanism reduces and a cleaning failure is apt to occur.

In view of such problems, investigations have been conducted on a material for the magnetic toner and on the control of the state of dispersion of magnetic particles in the magnetic toner for improving developing performance under an environment where the temperature increase is assumed. The investigations include an investigation on an approach to subjecting the surface of the magnetic particles to a hydrophobic treatment to disperse the magnetic particles in the toner particles. Two representative methods are available for the hydrophobic treatment of the magnetic particles. The two methods are a wet treatment performed in water and a dry treatment performed in a vapor phase. The wet treatment has an advantage that the surface of the magnetic particles can be made hydrophobic in a nearly uniform manner, and the dry treatment has an advantage that the treatment is performed with extreme ease. Investigations have been conventionally conducted on the dry treatment by reason of its ease, and techniques concerning various treatment agents have been disclosed (see Japanese Patent Application Laid-open No. 2004-294480).

In addition, a technique to suppress the water vapor adsorption on a magnetic particles through a treatment with a vaporized fluoroalkylsilane and/or a vaporized alkoxysilane has also been disclosed (see Japanese Patent Application Laid-open No. 2000-327948).

However, in the case of the magnetic particles described in each of Japanese Patent Application Laid-open No. 2004-294480 and Japanese Patent Application Laid-open No. 2000-327948, an affinity between an untreated magnetic particles and the treatment agent is insufficient, and hence an untreated portion may remain on the surface of the magnetic particles after the treatment. The untreated portion is apt to adsorb moisture because the portion is hydrophilic. When any such magnetic particles are used to produce toner, the toner shows insufficient development stability in its long-term use under a high-temperature and high-humidity environment.

SUMMARY OF THE INVENTION

An object of the present invention is to solve the above problems of the prior arts. That is, the present invention provides a magnetic toner excellent in development stability in long-term use under a high-temperature and high-humidity environment.

The invention of the subject application relates to a magnetic toner, including: magnetic toner particles each containing a binder resin and a treated magnetic particles; and an inorganic fine powder, in which: the treated magnetic particles being surface-treated with a silane compound; the silane compound has a hydrocarbon group having 2 to 4 carbon atoms; the treated magnetic particles has a moisture adsorption per unit area based on a BET specific surface area of 0.300 $mg/m^2$ or less; and the amount of styrene extractables in the silane compound constitutes 25 mass % or less in total amount of the silane compound contained in the treated magnetic particles.

That is, the present invention can provide a toner excellent in development stability in long-term use under a high-temperature and high-humidity environment.

Further features of the present invention will become apparent from the following description of exemplary embodiments with reference to the attached drawings.

DESCRIPTION OF REFERENCE NUMERALS

Figure 1:
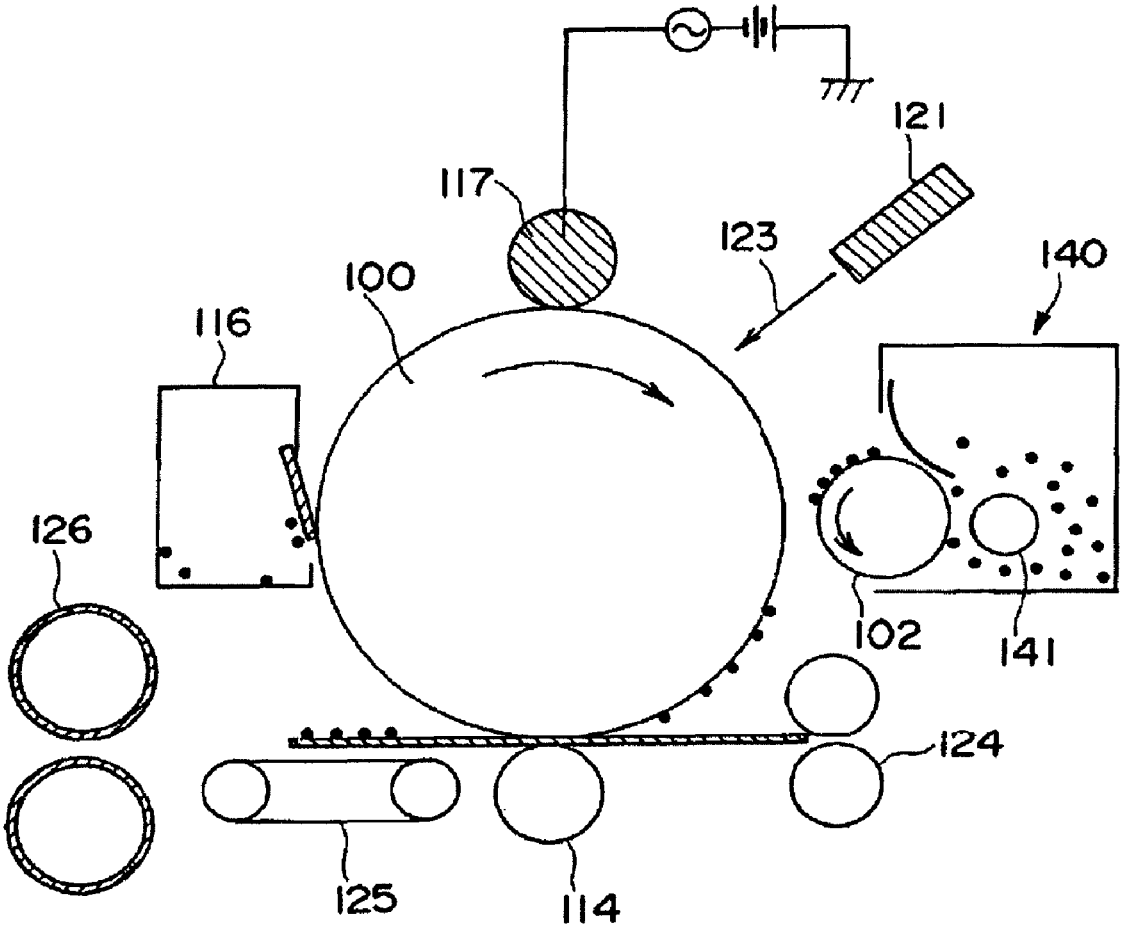
FIG. 1 is a schematic sectional view illustrating an example of an image-forming apparatus in which a toner of the present invention can be suitably used.

100 electrostatic latent image-bearing member (photosensitive member)
102 toner carrying member
114 transfer member (transfer roller)
116 cleaner
117 contact charging member (charging roller)
126 fixing unit
140 developing device

DESCRIPTION OF THE EMBODIMENTS

The term "treated magnetic particles" as used in the present invention refers to a magnetic particles obtained by subjecting an untreated magnetic particles to a surface treatment. Hereinafter, in the specification, the untreated magnetic particles may be simply referred to as "magnetic particles."

The inventors of the present invention have found that the developing performance of a magnetic toner under a high temperature and a high humidity is germane to the moisture-adsorbing performance of the magnetic toner. A treated magnetic particles itself in the magnetic toner must have low moisture-adsorbing performance in order to improve the moisture-adsorbing performance of the magnetic toner.

Therefore treated magnetic particles with less moisture adsorption have been investigated in order to reduce the moisture adsorption of a magnetic toner. However, treated magnetic particles with conventional surface treatment have unreacted OH groups or unreacted alkoxy groups, and hence moisture adsorption occurs resulting from such groups. When the amount of a silane compound with which the magnetic particles is treated is merely increased for suppressing the moisture adsorption, or the magnetic particles is subjected to a heat treatment at a high temperature for reducing the number of unreacted OH groups, the amount of a condensate of the silane compound increases, and hence it becomes difficult to make the surface of the treated magnetic particles hydrophobic in a uniform manner.

By such reasons as described above, the moisture adsorption amount of the treated magnetic particles upon production of the magnetic toner must be reduced in order that the moisture-adsorbing of the magnetic toner may be reduced. To be specific, the treated magnetic particles must have a moisture adsorption amount per unit area based on a BET specific surface area of 0.300 mg/m$^2$ or less.

In addition, when the treatment agent for the treated magnetic particles peels during the production of the toner, the peeled treatment agent remains in the toner which will cause the moisture-adsorption of the tonner. Accordingly, it is also important that adhesion between the magnetic particles and the treatment agent be improved. The investigations conducted by the inventors of the present invention have confirmed that, when the amount of the styrene extractables of silane compound constitutes 25 mass % or less of the total amount of the silane compound in the treated magnetic particles, the adhesion between the magnetic particles and the treatment agent (silane compound) improves, and hence the peeling of the treatment agent from the treated magnetic particles can be prevented. The styrene extractables of silane compound may originate from the treatment agent which is weakly bonded to the surface of the treated magnetic particles or from the treatment agent which is not bonded.

As described above, the moisture-adsorption of the magnetic toner is significantly reduced when the treated magnetic particles have a moisture adsorption amount per unit area based on a BET specific surface area of 0.300 mg/m$^2$ or less and the amount of the styrene extractables of silane compound constitutes 25 mass % or less of the total amount of the silane compound in the treated magnetic particles. As a result, developing performance of the tonner under a high temperature and a high humidity is drastically improved. The moisture-adsorption of the magnetic toner based on a BET specific surface area is preferably 0.200 mg/m$^2$ or less and more preferably 0.180 mg/m$^2$ or less.

When the above treated magnetic particles has a moisture adsorption amount per unit area based on a BET specific surface area in excess of 0.300 mg/m$^2$, the moisture-adsorption of the toner increases due to the moisture-adsorption of the treated magnetic particles. As a result, the developing performance of the toner deteriorates under a high temperature and a high humidity environment. When the amount of the styrene extractables in the silane compound constitutes more than 25 mass % among the total silane compound in the treated magnetic particles, the adhesion between the magnetic particles and the treatment agent (silane compound) is not sufficient. As a result, the treatment agent contained in the treated magnetic particles peels off during the production of the toner, and hence the moisture-adsorption of the toner increases and the toner shows poor developing performance under a high temperature and a high humidity environment.

The silane compound used in the present invention has a hydrocarbon group having 2 to 4 carbon atoms. When the number of carbon atoms of the hydrocarbon group of the silane compound falls within the above range, the surface of the treated magnetic particles is modified in a nearly uniform manner, and the hydrophobicity of the treated magnetic particles is improved. When the number of carbon atoms of the silane compound is smaller than 2, it becomes difficult to make the treated magnetic particles sufficiently hydrophobic. When the number of carbon atoms of the silane compound is greater than 4, the silane compound becomes bulky, and hence the adhesion between the silane compound and the surface of the magnetic particles becomes insufficient.

There are two kinds of possible methods of treating the surface of the magnetic particles, i.e., a wet method and a dry method.

The wet method involves dispersing the magnetic particles in water or an aqueous medium to prepare slurry, adding the silane compound to the slurry, ensuring an OH group present on the surface of the magnetic particles and the silane compound to react with each other while stirring the mixture, taking the magnetic particles out of water after the reaction, and condensing the silane compound while drying the magnetic particles at a high temperature to treat the surface of the magnetic particles. In the wet method, however, the treatment is performed in water or the aqueous medium, and hence water is apt to coordinate partially to any one of the OH groups present on the surface of the magnetic particles. Further, the reaction with the silane compound hardly occurs in a portion to which water coordinates out of the OH groups present on the surface of the magnetic particles. As a result, in such treated magnetic particles after the drying step, an OH group on the surface of the magnetic particles remains unreacted, and further, the abundance of OH groups derived from the silane compound increases. Consequently the treated magnetic particles adsorb high level of moisture, and it becomes difficult to control the moisture adsorption within the range specified in the present invention. In addition, the adhesion between the magnetic particles and the treatment agent becomes insufficient, and hence the treatment agent peels off easily from the surface of the magnetic particles.

On the other hand, the dry method involves spraying the silane compound, or a dispersion of the silane compound in water or an aqueous medium while stirring the magnetic particles in a high-speed stirring machine such as a Henschel mixer, and condensing the silane compound while drying the magnetic particles at a high temperature to treat the surface of the magnetic particles. In the dry method, the magnetic particles is treated in a vapor phase where only a trace amount of water is present, and hence water hardly coordinates to any one of the OH groups present on the surface of the magnetic particles, and each OH group present on the surface of the magnetic particles and the silane compound easily react with each other. As a result, in the treated magnetic particles after the drying, the amount of OH groups derived from the silane compound reduces, and hence the moisture adsorption of the treated magnetic particles can be reduced. In addition to the above, the adhesion between the magnetic particles and the treatment agent is improved, and hence the portion of the styrene extractables among the silane compound contained in the magnetic particles can be suppressed to a low level.

Even in the case where the dry method is adopted, however, the surface of the magnetic particles cannot be uniformly coated when an affinity between the silane compound and the surface of the magnetic particles is low. Accordingly, the moisture adsorption and the portion of the styrene extractables among the silane compound in the treated magnetic particles increase. In view of the foregoing, a treated product obtained by subjecting an alkoxysilane to a hydrolysis treatment is preferably used as the silane compound in the treatment of the magnetic particles. That is, it is preferred that the alkoxysilane be sufficiently subjected to the hydrolysis treatment in advance, and the surface of the magnetic particles be treated with such hydrolyzed product. When the alkoxysilane is sufficiently subjected to the hydrolysis treatment before its use, the hydrolyzed product becomes more reactive with an OH group on the surface of the magnetic particles, and hence the surface of the magnetic particles can be modified in a nearly uniform manner and to a sufficient extent. When an alkoxy group in the alkoxysilane still remains after hydrolysis treatment, the alkoxy group in the alkoxysilane and an OH group on the surface of the magnetic particles do not sufficiently react with each other. Consequently, the adhesion between the magnetic particles and the silane compound becomes poor.

As described above, when the magnetic particles is treated by the dry method with the alkoxysilane which is subjected sufficiently to the hydrolysis treatment, the adhesion between the magnetic particles and the alkoxysilane is improved, and also the portion of styrene extractables of the alkoxysilane in the magnetic particles reduces in the present invention. When such treated magnetic particles are used in the toner, the toner to be obtained is hardly affected by humidity and temperature. Accordingly, an image density can be kept high even when a printer is used under high-temperature and high-humidity environment over a long time period.

It should be noted that, in order that the alkoxysilane may be sufficiently hydrolyzed in the present invention, the hydrolysis has to be fully performed by controlling, for example, the temperature and pH of an aqueous solution.

The hydrolysis treatment has to be performed so as to a hydrolysis ratio of 50% or more, or more preferably 80% or more be attained.

Specific procedure to measure the hydrolysis ratio is described later.

When the treated product obtained by subjecting the alkoxysilane to the hydrolysis treatment has a hydrolysis ratio of 50% or more, the affinity between the surface of the magnetic particles and the treatment agent is improved, and hence the magnetic particles can be treated in a nearly uniform manner. There is no upper limit for the hydrolysis ratio, and a hydrolysis ratio of 100% is also permitted. The hydrolysis ratio can be set to fall within the above range by adjusting the pH and temperature of the aqueous solution upon loading of the alkoxysilane into the solution, and by adjusting the time period for which the hydrolysis is performed.

In addition, a ratio of a hydrolysate present as a siloxane to the treated product obtained by subjecting the alkoxysilane to the hydrolysis treatment (which may hereinafter be referred to as "siloxane ratio") is preferably 35% or less. The term "siloxane" refers to a compound having a silicon-oxygen-silicon bond. Specific procedure to measure the siloxane ratio is described later.

The siloxane is produced by a condensation reaction between the molecules of the hydrolyzed alkoxysilane, and is bulkier than the alkoxysilane. As the siloxane ratio increases, the reactivity of the alkoxysilane with the surface of the magnetic particles reduces. In order that the surface of the magnetic particles may be treated in a nearly uniform manner, it is important that the siloxane ratio be suppressed to a low level. When the siloxane ratio is 35% or less, a reduction in reactivity of the alkoxysilane caused by the presence of the siloxane can be suppressed, and the surface of the magnetic particles can be treated in a nearly uniform manner and to a sufficient extent. The siloxane ratio can be set to fall within the above range by appropriately adjusting a condition under which the alkoxysilane is hydrolyzed.

The surface of the treated magnetic particles is preferably coated with a proper amount of the silane compound. A simple method of measuring the amount of the silane compound on the surface is, for example, to measure the amount of carbon derived from a hydrocarbon group of the silane compound. The treated magnetic particles preferably has a carbon amount per unit area based on the BET specific surface area of the treated magnetic particles of 0.050 $g/m^2$ or more and 0.100 $g/m^2$ or less. When the carbon amount of the treated magnetic particles falls within the above range, the hydrophobicity of the surface of the treated magnetic particles is improved, and hence the following tendency is observed. That is, an image density under a high temperature and a high humidity can be kept high.

The above carbon amount per unit area based on the BET specific surface area of the treated magnetic particles is more preferably 0.055 $g/m^2$ or more and 0.100 $g/m^2$ or less, or still more preferably 0.055 $g/m^2$ or more and 0.09 $g/m^2$ or less. The carbon amount per unit area of the treated magnetic particles can be set to fall within the above range by adjusting the addition amount of the silane compound used at the time of the production of the treated magnetic particles and selecting the kind of the silane compound.

The magnetic toner of the present invention is preferably produced in an aqueous medium. In addition, the toner is more preferably produced by a suspension polymerization method involving dispersing a polymerizable monomer composition containing a polymerizable monomer and the magnetic particles in the aqueous medium, and polymerizing the polymerizable monomer with a polymerization initiator. When the magnetic toner particles are produced by the suspension polymerization method, the treated magnetic particles can be caused to exist in, and near the surface of, each magnetic toner particle without being exposed to the surface of the toner particle. Further, the magnetic toner of the present invention preferably contains a polar substance. When the magnetic toner is produced by the suspension polymerization method, the polar substance can be unevenly distributed to the surfaces of the toner particles. When the polar substance is present on the surface of each toner particle, charge stability is further improved by an electrical interaction between the polar substance and the treated magnetic particles.

Examples of the binder resin to be used in the magnetic toner of the present invention include: homopolymer of styrene and of a substituted product thereof such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate; a silicone resin; a polyester resin; a polyamide resin; an epoxy resin; and a polyacrylic resin. Each of them can be used alone, or two or more of them can be used in combination. Of those, a styrene-acrylic resin formed of a copolymer of styrene and an acrlylic monomer is particularly preferred in terms of developing characteristics.

The magnetic toner of the present invention preferably contains a charge control agent as a polar substance. A known charge control agent can be utilized as the charge control agent. A charge control agent which allows the toner to be charged at a high speed and to be capable of stably maintaining a constant charge quantity is particularly preferred.

Further, when the toner is produced by employing such a polymerization method as described later, a charge control agent showing low polymerization-inhibiting performance, substantially free of any solubilized product in an aqueous dispersion medium, and having relatively high polarity is particularly preferred. Specific examples of a charge control agent to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; polymers or copolymers each having a sulfonic acid group, a sulfonate group, or a sulfonic acid ester group; boron compounds; urea compounds; silicon compounds; and calixarene. Specific examples of a charge control agent to serve as a positive charge control agent include: quaternary ammonium salts; polymeric compounds having the quaternary ammonium salts at their side chains; guanidine compounds; and imidazole compounds. Of those, the polymers or copolymers each having a sulfonic group, a sulfonate group, or a sulfonic acid ester group are preferred because each of them can be preferentially distributed to the surface of the magnetic toner when combined with the suspension polymerization method.

A general method of incorporating the charge control agent into the magnetic toner is to add the agent to the inside of each magnetic toner particle. When the magnetic toner is produced by suspension polymerization, a method involving adding the charge control agent to the polymerizable monomer composition before granulation is employed. In addition, when an organometallic compound is used as the charge control agent, the charge control agent can be introduced by: adding such compound to each magnetic toner particle; and mixing and stirring the particles while applying a shear.

The magnetic particles is mainly formed of a magnetic iron oxide such as triiron tetroxide or γ-iron oxide, and may contain an element such as phosphorus, cobalt, nickel, copper, magnesium, manganese, aluminum, or silicon. The magnetic particles has a BET specific surface area according to a nitrogen adsorption method of preferably 2.0 $m^2/g$ or more and 30.0 $m^2/g$ or less, or more preferably 3.0 $m^2/g$ or more and 28.0 $m^2/g$ or less. Examples of the shape of the magnetic particles include a polygonal shape, an octahedral shape, a hexagonal shape, a spherical shape, a needle-like shape, and a flaky shape. Of those, a shape having low anisotropy such as a polygonal shape, an octahedral shape, a hexagonal shape, or a spherical shape is preferred for increasing an image density.

The magnetic particles can be produced by, for example, the following method. An alkali such as sodium hydroxide is added in an amount equivalent to or more than an iron component of an aqueous solution of a ferrous salt to the solution, to thereby prepare an aqueous solution containing ferrous hydroxide. Air is blown while the pH of the prepared aqueous solution is maintained at 7.0 or more, and an oxidation reaction of ferrous hydroxide is performed while the aqueous solution is heated to 70° C. or higher. Thus, a seed crystal serving as a core of a magnetic iron oxide particle is first produced.

Next, an aqueous solution containing about 1 equivalent of ferrous sulfate based on the amount of the alkali previously added is added to a slurry-like liquid containing the seed crystal. Air is blown while the pH of the liquid is maintained at 5.0 or more and 10.0 or less, and a reaction of ferrous hydroxide is advanced to grow the magnetic iron oxide particle with the seed crystal as a core. At this time, the shape and magnetic properties of the magnetic particles can be controlled by arbitrarily selecting a pH, a reaction temperature, and a stirring condition. As the oxidation reaction proceeds, the pH of the liquid shifts to lower values. Preferably, however, the pH of the liquid is not less than 5.0. The magnetic particles thus obtained is filtered, washed, and dried according to an ordinary method to provide a magnetic particles.

The hydrolysis treatment of the alkoxysilane can be performed by, for example, the following method. The hydrolysis treatment is performed by gradually loading the alkoxysilane into the aqueous solution with its pH adjusted to 4 or more and 6 or less, stirring the mixture with a disper blade or the like to disperse the alkoxysilane uniformly, and adjusting a dispersion time period so that a desired hydrolysis ratio may be obtained. When a dispersing apparatus capable of providing a high shear is used, the alkoxysilane forms an emulsion. Accordingly, an area of contact between the alkoxysilane and water drastically increases, and the hydrolysis ratio can be increased in a state where the siloxane ratio is kept low. In addition, in this case, it is also important that the pH at the time of the hydrolysis be suitably adjusted. When the pH is excessively high or excessively low, a condensation reaction between the molecules of the silane compound proceeds, or the hydrolysis hardly proceeds. The pH region should be adjusted so as to achieve desired hydrolysis ratio and siloxane ratio since the above ratio varies depending on the kind of the alkoxysilane to be used. Accordingly, the pH must be appropriately adjusted while measuring the hydrolysis ratio and the siloxane ratio. Thus, an aqueous solution in which the alkoxysilane being hydrolyzed is obtained.

Next, a specific method for the dry treatment is exemplified. A method involving volatilizing the treatment agent to perform the treatment, a method involving spraying with an apparatus such as a spray dryer, and an approach involving stirring with an apparatus such as a Henschel mixer while applying a shear are each available as a method for the dry treatment. Of those, the approach involving performing the treatment with a stirring apparatus such as a Henschel mixer is preferred because of its simplicity and its ease with which the physical properties of the treated magnetic particles are controlled to those requested in the present invention. When such treatment method is employed, a magnetic particles having a hydrolysate of the silane compound adsorbing to its surface is obtained by dropping the above aqueous solution while dispersing an untreated magnetic particles and further dispersing the magnetic particles after the dropping. Subsequently, the condensation reaction proceeds by heating. Thus, a treated magnetic particles subjected to a hydrophobic treatment is obtained.

As a silane compound which may be used in the surface processing of the magnetic particles, alkylalkoxysilanes represented by the formula (1) is preferred:

$$C_pH2_{p+1}\text{-Si—}(OC_qH_{2q+1})_3 \quad (1)$$

(In the formula, p represents an integer of 2 to 4, and q represents an integer of 1 to 3.)

Examples of the alkylalkoxysilanes represented by the formula (1) include diethyldimethoxysilane, ethyltriethoxysilane, ethyltrimethoxysilane, diethyldiethoxysilane, diethyldimethoxysilane, triethylmethoxysilane, n-propyltriethoxysilane, n-propyltrimethoxysilane, isopropyltriethoxysilane, isopropyltrimethoxysilane, n-butyltrimethoxysilane, n-butyltriethoxysilane, isobutyltrimethoxysilane, isobutyltriethoxysilane, and trimethylmethoxysilane.

When p in the above formula is smaller than 2, hydrophobicity cannot be sufficiently imparted to the treated magnetic particles. In addition, when p is larger than 4, the state of presence of the treated magnetic particles in the magnetic toner cannot be controlled, though the hydrophobicity becomes sufficient. When q is larger than 3, the reactivity of the alkylalkoxysilane reduces and it becomes difficult to make the magnetic particles sufficiently hydrophobic. Accordingly, an alkyltrialkoxysilane in which q represents an integer of 1 to 3 is preferably used, and an alkyltrialkoxysilane in which q represents an integer of 1 or 2 is more preferably used.

When the above alkoxysilane is used, the treatment can be performed with one kind of alkoxysilane alone, or can be performed with multiple kinds of alkoxysilanes in combination. When multiple kinds of alkoxysilanes are used in combination, the treatment may be performed with each of them individually, or may be performed with them simultaneously.

In the magnetic toner of the present invention, any other colorant may be used in combination with the treated magnetic particles. Examples of the colorant that can be used in combination include the above known dyes and pigments, and magnetic or non-magnetic inorganic compounds. Specific examples of the colorant include particles of ferromagnetic metals such as cobalt and nickel, alloys obtained by adding chromium, manganese, copper, zinc, aluminum, rare earth elements, and the like to the metals, particles of hematite and the like, titanium black, carbon black, and phthalocyanine. Each of them is also preferably used after its surface has been treated. Any such colorant including the treated magnetic particles is preferably used in an amount of 30 parts by mass or more and 120 parts by mass or less with respect to 100 parts by mass of the binder resin.

The magnetic toner of the present invention preferably has a glass transition temperature (Tg) of 40.0° C. or higher and 70.0° C. or lower. When the glass transition temperature of the magnetic toner falls within the above range, a good balance is established among the fixing performance, storage stability, and developing performance of the toner.

The magnetic toner of the present invention preferably has a core-shell structure for further improving its durable developing performance. This is because the presence of a shell layer not only provides the toner with a uniform surface to improve its flowability but also uniformizes the charging performance of the toner. In addition, the surface layer is uniformly coated with the shell of a high-molecular weight body, and hence the exudation of a low-melting point substance and the like hardly occurs even in long-term storage and the storage stability is improved.

An amorphous high-molecular weight body is preferably used in the above shell layer, and the polymer used in the shell layer preferably has an acid value of 5.0 mgKOH/g or more and 20.0 mgKOH/g or less from the viewpoint of charge stability.

A specific available approach to forming the shell is an approach involving embedding fine particles for the shell in core particles or, when the magnetic toner is produced in the aqueous medium, an approach involving causing the fine particles for the shell to adhere to the core particles and drying the resultant to form the shell layer. In addition, in a solution suspension method or the suspension polymerization method, the shell can be formed by unevenly distributing such high-molecular weight body for the shell to an interface with water, i.e., the vicinity of the surface of the magnetic toner by means of the affinity of the high-molecular weight body. Further, the shell can be formed by the so-called seed polymerization method involving swelling a monomer on the surface of each core particle and polymerizing the monomer. Amorphous polyester is particularly preferably used as a shell-forming resin because the preferential solvation effect of the above is effectively achieved.

A resin appropriately selected from a saturated polyester resin, an unsaturated polyester resin, and a mixture of both of them can be used as the amorphous polyester resin that can be used in the present invention. An ordinary resin constituted of an alcohol component and an acid component can be used as the amorphous polyester resin.

Examples of alcohol components include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, and bisphenol derivatives.

Examples of divalent carboxylic acids include: benzene dicarboxylic acids such as phthalic acid, terephthalic acid, isophthalic acid, and phthalic anhydride, or anhydrides thereof; alkyldicarboxylic acids such as succinic acid, adipic acid, sebacic acid, and azelaic acid, or anhydrides thereof; succinic acid having a substituted alkyl or alkenyl group with 6 to 18 carbon atoms, or anhydrides thereof; and unsaturated dicarboxylic acids such as fumaric acid, maleic acid, citraconic acid, and itaconic acid, or anhydrides thereof.

Further, examples of polyhydric alcohol components include polyhydric alcohols such as glycerine, pentaerythritol, sorbit, sorbitan, and oxyalkylene ether of a novolac type phenol resin, and examples of polyhydric acid components include polyvalent carboxylic acids such as trimellitic acid, pyromellitic acid, 1,2,3,4,-butane tetracarboxylic acid, and benzophenone tetracarboxylic acid, or anhydrides thereof.

Of the above amorphous polyester resins, an alkylene oxide adduct of bisphenol A described above is preferably used because of its excellent charging characteristic and excellent environmental stability, and its other balanced electrophotographic characteristics. In the case of the compound, the average addition number of moles of the alkylene oxide is preferably 2.0 mol or more and 10.0 mol or less in terms of the fixing performance and the durability of the toner. In addition, the high-molecular weight body of which the shell is formed preferably has a number-average molecular weight (Mn) of 2500 or more and 20,000 or less.

With regard to a production method in the aqueous medium, the magnetic toner particles are preferably produced in the aqueous medium by, for example, a dispersion polymerization method, an association agglomeration method, a solution suspension method, or a suspension polymerization method. The suspension polymerization method is particularly preferred because the effect of the treated magnetic particles used in the present invention is easily achieved.

The suspension polymerization method involves the stages of uniformly dissolving or dispersing a polymerizable monomer and a colorant (and further, as required, a polymerization initiator, a crosslinking agent, a charge control agent, and any other additive) to provide a polymerizable monomer composition and dispersing the polymerizable monomer composition in an aqueous phase containing a dispersion stabilizer with a proper stirrer and performing a polymerization reaction simultaneously with the dispersion to provide magnetic toner particles each having a desired particle diameter. The magnetic toner particles obtained by the suspension polymerization method are expected to show improved durable developing performance because the shapes of the respective magnetic toner particles are substantially uniformized to a spherical shape and hence a charge quantity distribution also becomes relatively uniform.

Examples of the polymerizable monomer of which the polymerizable monomer composition is constituted include the following compounds.

Examples of the polymerizable monomer include styrene-based monomers such as styrene, o-methylstyrene, m-methylstyrene, p-methylstyrene, p-methoxystyrene, and p-ethylstyrene; monomers of acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; monomers of methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and monomers of acrylamide. Those monomers may be used alone or in mixture. Of the above-mentioned monomers, in terms of developing characteristics and durability of the magnetic toner, styrene or a styrene derivative is preferably used alone or used in mixture with other monomers.

When the magnetic toner particles are produced by a production approach involving polymerizing the polymerizable monomer in the aqueous medium, an available polymerization initiator preferably has a half life at the time of the polymerization reaction of 0.5 hour or more and 30.0 hours or less. In addition, the addition amount of the polymerization initiator is preferably 0.5 part by mass or more and 20.0 parts by mass or less with respect to 100 parts by mass of the polymerizable monomer.

Specific examples of the polymerization initiator include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumenehydroperoxide, 2,4-dichlorobenzoyl peroxide, lauroyl peroxide, t-butylperoxy 2-ethylhexanoate, and t-butylperoxy pivalate.

A crosslinking agent may be added as required in the production of the magnetic toner particles. A preferred addition amount is 0.01 to part by mass or more and 10.00 parts by mass or less with respect to 100 parts by mass of the polymerizable monomer.

A compound having two or more polymerizable double bonds is used as a crosslinking agent. Specific examples thereof include: aromatic divinyl compounds such as divinylbenzene and divinylnaphthalene; carboxylates having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds having three or more vinyl groups. Those compounds may be used alone or as a mixture of two or more of them.

When the magnetic toner particles of the present invention are produced by the suspension polymerization method, the polymerizable monomer composition obtained by appropriately adding the above toner composition and the like and by uniformly dissolving or dispersing them with a dispersing machine such as a homogenizer, a ball mill, or an ultrasonic dispersing machine is suspended in the aqueous medium containing a dispersion stabilizer. In this case, the particle diameter distribution of the toner particles to be obtained becomes sharp when the toner particles are provided with desired sizes in one stroke with a high-speed stirring machine or a high-speed dispersing machine such as an ultrasonic dispersing machine. With regard to addition point at which the polymerization initiator is added, the initiator may be added simultaneously with the addition of any other additives to the polymerizable monomer, or may be mixed immediately before the suspension in the aqueous medium. Alternatively, the polymerization initiator dissolved in the polymerizable monomer or in a solvent can be added immediately after suspending and before the initiation of the polymerization reaction. After suspending, stirring has to be performed with an ordinary stirring machine to such an extent that the suspended droplet size is maintained, and the floatation and sedimentation of the particles are prevented.

Any one of the known surfactants, organic dispersants, and inorganic dispersants can be used as the dispersion stabilizer. Of those, the inorganic dispersants can each be preferably used because of the following reasons. The inorganic dispersants each hardly produce a noxious ultrafine powder. In addition, each of the inorganic dispersants obtains its dispersion stability by virtue of its steric hindrance, and hence its stability is hardly lost even when a reaction temperature is changed. Further, each of the inorganic dispersants can be easily washed and hardly has an adverse effect on the toner. Examples of such inorganic dispersants include: polyvalent metal phosphates such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Any such inorganic dispersant is preferably used in an amount of 0.20 part by mass or more and 20.00 parts by mass or less with respect to 100 parts by mass of the polymerizable monomer. In addition, each of the above dispersion stabilizers may be used alone, or multiple kinds of them may be used in combination. Further, a surfactant may be used in combination in an amount of 0.0001 part by mass or more and 0.1000 part by mass or less with respect to 100 parts by mass of the polymerizable monomer.

When any such inorganic dispersant is used, the dispersant may be used as it is. In order that finer particles may be obtained, the particles of the inorganic dispersant produced in the aqueous medium can be used. In the case of, for example, tricalcium phosphate, water-insoluble calcium phosphate can be produced by mixing an aqueous solution of sodium phosphate and an aqueous solution of calcium chloride under high-speed stirring, and enables more uniform, finer dispersion. In this case, a water-soluble sodium chloride salt is simultaneously produced as a by-product. The presence of a water-soluble salt in the aqueous medium is more convenient because the presence suppresses the dissolution of the polymerizable monomer in water to raise the difficulty with which an ultrafine toner is generated by emulsion polymerization.

Examples of the surfactants include sodium dodecylbenzene sulfate, sodium tetradecyl sulfate, sodium pentadecyl sulfate, sodium octyl sulfate, sodium oleate, sodium laurate, sodium stearate, and potassium stearate.

In the step of polymerizing the above polymerizable monomer, a polymerization temperature is set to a temperature of generally 40° C. or higher, or preferably 50° C. or higher and 90° C. or lower.

After the completion of the above step, the resultant polymer particles are filtrated, washed, and dried by known methods. Thus, the magnetic toner particles are obtained. The magnetic toner particles are mixed with such an inorganic fine powder as described later as required so that the inorganic fine powder may adhere to the surface of each of the magnetic toner particles. Thus, the magnetic tonner of the present invention can be obtained. In addition, a classifying step can be incorporated into the production steps (before the mixing of the inorganic fine powder) so that the fraction of coarse or fine particles in the magnetic toner particles might be eliminated.

The magnetic toner of the present invention contains an inorganic fine powder. Examples of the inorganic fine powder used in the present invention include silica, titanium oxide, and alumina.

The inorganic fine powder is preferably subjected to a hydrophobic treatment because the environmental stability of the magnetic toner can be improved. The inorganic fine powder is preferably incorporated in an amount of 0.1 part by mass or more and 3.0 parts by mass or less with respect to 100 parts by mass of the magnetic toner particles.

In the magnetic toner, any other additives may be additionally used as long as they do not substantially give any adverse effect. For example, there can be used lubricant powders such as a polyfluoroethylene powder, a zinc stearate powder, and a polyvinylidene fluoride powder, abrasives such as a cerium oxide powder, a silicon carbide powder, and strontium titanate powder; fluidity imparting agents such as a titanium oxide powder and an aluminum oxide powder; and caking inhibitors. Further, organic fine particles of reverse polarity and inorganic fine particles of reverse polarity may be used in a small amount as a developing performance improver. Those additives may also be used after subjecting their surfaces to hydrophobic treatment.

The magnetic toner of the present invention can be used as a one-component developer by being further mixed with any other external additive (such as a charge control agent) as required, or can be used as a two-component developer by being used in combination with a carrier.

Next, an example of an image-forming apparatus in which the magnetic toner of the present invention can be suitably used is specifically described with reference to FIG. 1. In FIG. 1, a charging roller 117, a developing device 140 having a toner carrying member 102, a transfer member (transfer roller) 114, a cleaner 116, a register roller 124, and the like are provided around an electrostatic latent image-bearing member (which may hereinafter be referred to as "photosensitive member") 100. The electrostatic latent image-bearing member 100 is charged to, for example, −600 V by the charging roller 117 (an applied voltage is, for example, an alternating voltage of 1.85 kVpp or a direct voltage of −620 Vdc). In addition, the electrostatic latent image-bearing member 100 is irradiated with laser light 123 from a laser-generating apparatus 121 so that exposure may be performed. Thus, an electrostatic latent image corresponding to a target image is formed. The electrostatic latent image on the electrostatic latent image-bearing member 100 is developed with a one-component toner by the developing device 140 so that a toner image may be obtained. The toner image is transferred onto a transfer material by the transfer roller 114 abutting the electrostatic latent image-bearing member through the transfer material. The transfer material bearing the toner image is conveyed to a fixing unit 126 by a transport belt 125 and the like so that the image may be fixed on the transfer material. In addition, the toner partly remaining on the electrostatic latent image-bearing member is cleaned by the cleaner 116.

Next, methods of measuring the physical properties of the magnetic toner of the present invention are described.

(1) Method of Measuring the Amount of Moisture Adsorption Per Unit Area Based on BET Specific Surface Area of Treated Magnetic Particles The amount of moisture adsorption per unit area based on the BET specific surface area of the treated magnetic particles in the present invention is calculated by using numerical values measured for the BET specific surface area and moisture adsorption amount of the treated magnetic particles used. To be specific, the calculation is performed by dividing a moisture adsorption amount per unit weight obtained in the following section [2] by the BET specific surface area obtained in the following section [1].

[1] BET Measurement for Treated Magnetic Particles

The BET specific surface area is measured with a degassing apparatus VacuPrep 061 (manufactured by Micromesotics) and a BET measuring apparatus Gemini 2375 (manufactured by Micromesotics). The BET specific surface area in the present invention is a value for a BET specific surface area by a multipoint method. To be specific, the measurement is performed by the following procedure.

After the mass of an empty sample cell has been measured, 2.0 g of the treated magnetic particles are weighed and loaded into the sample cell. Further, the sample cell loaded with the sample is set in the degassing apparatus, and degassing is performed at room temperature for 12 hours. After the completion of the degassing, the mass of the entire sample cell is measured, and the accurate mass of the sample is calculated from a difference with the mass of the empty sample cell. Next, an empty sample cell is set in each of the balance port and analysis port of the BET measuring apparatus. A Dewar flask containing liquid nitrogen is set at a predetermined position, and a saturated vapor pressure (P0) is measured by a P0 measurement command. After the completion of the measurement of the P0, the sample cell subjected to the degassing is set in the analysis port, and the sample mass and the P0 are input. After that, measurement is initiated by a BET measurement command. After that, the BET specific surface area is automatically calculated.

[2] Measurement of Moisture Adsorption Amount of Treated Magnetic Particles

The treated magnetic particles are left to stand under an environment having a temperature of 30° C. and a humidity of 80% for 72 hours. After that, the moisture adsorption amount of the treated magnetic particles is measured with a moisture measuring apparatus manufactured by Hiranuma Sangyo Corporation. To be specific, the measurement is performed with a combination of a trace moisture measuring apparatus AQ-2100, an automatic heat-vaporized moisture measuring system AQS-2320, and an automatic moisture vaporizing apparatus SE320 by a Karl Fischer coulometric titration method. Conditions for the measurement are described below. An interval control system is adopted as a measurement system. A set time is 40 seconds, a heating temperature is 120° C., and the loading amount of the treated magnetic particles is 2.0 g. It should be noted that a moisture adsorption amount per unit weight is obtained by the measurement.

(2) Method of Measuring Amount of Components Eluted with Styrene of Silane Compound in Treated Magnetic Particles First, 20 g of styrene and 1.0 g of the treated magnetic particles are loaded into a glass vial having a volume of 50 ml. Then, the glass vial is set in a "KM Shaker" (model: V.SX) manufactured by IWAKI INDUSTRY CO., LTD. The speed is set to 50 and the vial is shaken for 1 hour so that the treatment agent in the treated magnetic particles may be eluted with styrene. After that, the treated magnetic particles and styrene are separated from each other, and the treated magnetic particles is sufficiently dried with a vacuum dryer.

The carbon amount per unit weight of each of the treated magnetic particles that has been dried and the treated magnetic particles before the elution with styrene is measured with a carbon/sulfur analyzer EMIA-320V manufactured by HORIBA, Ltd. The ratio at which the silane compound in the treated magnetic particles is eluted with styrene is calculated with the carbon amounts before and after the elution with styrene. It should be noted that the loading amount of the sample at the time of the measurement with the EMIA-320V is 0.20 g, and tungsten and tin are each used as a firework fuel.

(3) Method of Measuring Carbon Amount Per Unit Area are Based on BET Specific Surface Area of Treated Magnetic Particles The carbon amount per unit area based on the BET specific surface area of the treated magnetic particles is calculated by dividing the carbon amount of the treated magnetic particles obtained in the section (2) by the BET specific surface area obtained in the section (1) [1].

(4) Method of Measuring Hydrolysis Ratio of Silane Compound

The hydrolysis ratio of a silane compound is described. Subjecting an alkoxysilane to a hydrolysis treatment provides a mixture constituted of hydrolysates, an unhydrolyzed substance, and a condensate. Described below is the ratio of the hydrolysates in the resultant mixture. The mixture corresponds to the above silane compound.

The hydrolysis reaction of alkoxysilane is explained in terms of methoxysilane as an example. When methoxysilane is subjected to hydrolysis reaction, the methoxy group changes to hydroxyl group and methanol is formed. Therefore we can measure the degree of hydrolysis by measuring the ratio of the amount of methoxy group and the amount of methanol. In the present invention the foregoing ratio is measured by $^{1}$H-NMR (nuclear magnetic resonance). Specific procedure for measuring and calculating procedure of the above is explained in terms of methoxysilane as an example again.

First, $^{1}$H-NMR data of the methoxysilane before hydrolysis treatment is measured by using deuterated chloroform.

Thus the position of the peak which derives from methoxy group is identified. The aqua solution of methoxysilane which is to be used for magnetic particles treatment, was adjusted to have pH of 7.0 and temperature of 10° C. to terminate the hydrolysis just before the aqua solution is used to treat the magnetic particles. The aqua solution was dried and sample of the dried silane compound is obtained. Subsequently a small quantity of deuterated chloroform is added to the above dried silane compound and $^{1}$H-NMR data is obtained.

Referring the peak position of the methoxy group of the aforementioned methoxy silane itself, the peak which derives from the methoxy group in the hydrolyzed methoxysilane is identified. Thus the peak area (A) which derives from the methoxy group and the peak area (B) which derives from the methyl group of the methanol are identified. Subsequently the hydrolysis ratio as defined below is obtained.

$$\text{Hydrolysis ratio}(\%)=B/(A+B)\times 100$$

The $^{1}$H-NMR was measured by following condition.

Apparatus: FT NMR Apparatus JNM-EX400 (JEOL)
Frequency: 400 MHz
Pulse: 5.0 μs
Frequency Range: 10500 Hz
Number of integration: 1024 times
Temperature: 40° C.

(5) Method of Measuring the Amount of Siloxane in Hydrolysates Obtained by Hydrolyzing Alkoxysilane (Method of Measuring Siloxane Ratio)

Siloxane ratio as defined in this invention is the ratio of the hydrolysate component present as a siloxane to the treated product obtained by subjecting the alkoxysilane to the hydrolysis treatment. When the ratio of the condensate is high, a uniform treatment is inhibited as described above when the surface of the magnetic particles is treated.

The amount of the constituents in the silane compound is measured by gel permeation chromatography (GPC) as described below.

A GPC chart for alkoxysilane which is not hydrolyzed yet was obtained. The retention time corresponding to the alkoxysilane is identified. Then aqua solution of the alkoxysilane, which is to be used for the treatment of the magnetic particles, is so adjusted to have pH of 7.0 and temperature of 10° C. as to terminate the hydrolysis reaction. Acetic acid, triethylamine and ionized water are employed to adjust the pH value. Subsequently a quantity of acetonitrile was added and mixed to the solution to adjust the concentration of silane compound around 10 volume % in the solution.

The GPC chart is obtained for this solution with the following measuring condition.

Figure 2:
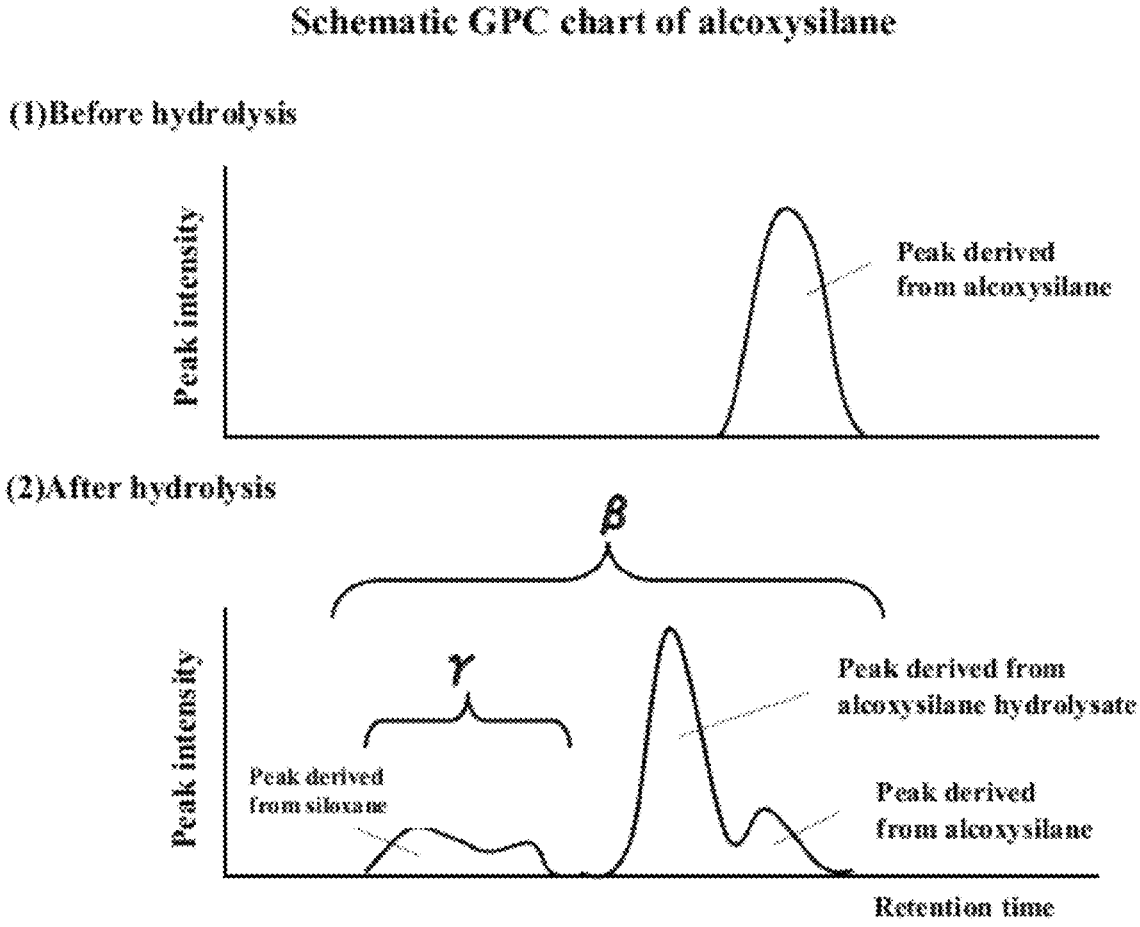
FIGS. 2 and 3 are views illustrating a schematic GPC chart and $^1$H-NMR chart of an alkoxy silane compound.
Figure 3:
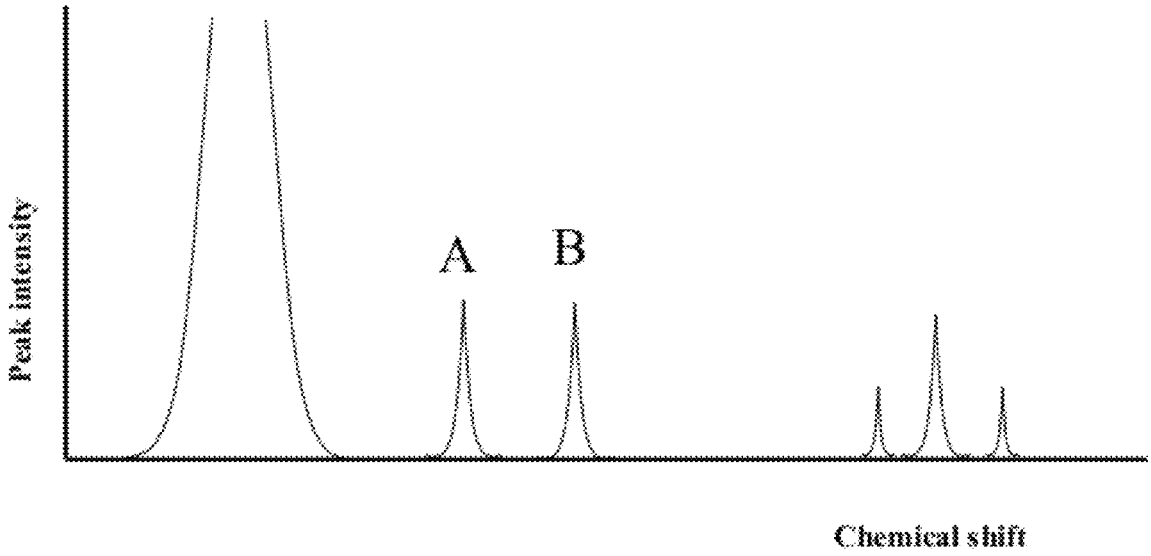

Apparatus: HLC8120 GPC (detector: RI) (manufactured by TOSOH CORPORATION)
Column: GF-3,0-HQ (manufactured by SHOWA DENKO K.K.)
Flow rate: 1.0 ml/minute
Oven temperature: 40.0° C.
Sample injection amount: 25 μL Next the procedure to calculate the siloxane ratio is described below. When the alkoxysilane is subjected to the measurement by GPC, such a chart as schematically illustrated in FIG. 2 is obtained. In FIG. 2 the charts of the alkoxysilane before hydrolysis treatment and after hydrolysis treatment are shown respectively. The lower chart of FIG. 2, which is the chart of the alkoxysilane after hydrolysis treatment, shows peaks which correspond to alkoxysilane, hydrolyzate of alkoxysilane and siloxane. Based on the chart the siloxane ratio is defined and calculated by the following equation;

$$\text{Siloxane ratio}(\%)=\gamma/\beta\times 100$$

Here, β represents the total area of the peaks of alkoxysilane, hydrolyzate of alkoxysilane and siloxane and γ represents the area of the peak of siloxane.

(6) Weight Average Particle Diameter and Grain Size Distribution of Toner

The weight average particle diameter (D4) of the toner is measured by using a precision grain size distribution measuring apparatus based on a pore electrical resistance method provided with a 100-μm aperture tube "Coulter Counter Multisizer 3" (registered trademark, manufactured by Beckman Coulter, Inc), and a dedicated software included with the apparatus "Beckman Coulter Multisizer 3 Version 3.51" (manufactured by Beckman Coulter, Inc) for setting measurement conditions and analyzing measurement data. The calculation of the weight-average particle diameter (D4) is performed while the number of effective measurement channels is set to 25,000 and the measurement data is analyzed.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software is set as described below prior to the measurement and the analysis.

In the "screen for the change of standard measurement method (SOM)" of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "screen for the setting for conversion from pulse to particle diameter" of the dedicated software, a bin interval is set to a logarithmic particle diameter, the number of particle diameter bins is set to 256, and a particle diameter range is set to the range of 2 μm to 60 μm.

A specific measurement method is as described below.

[1] About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

[2] About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a non-ionic surfactant, an anionic surfactant, and an organic builder and having a pH of 7, manufactured by Wako Pure Chemical Industries, Ltd.) with ion-exchanged water by three mass-fold is added as a dispersant to the electrolyte solution.

[3] An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which had an electrical output of 120 W is prepared. A predetermined amount of ion-exchanged water is charged into the water tank of the ultrasonic dispersing unit. About 2 ml of the Contaminon N are added to the water tank.

[4] The beaker in the section [2] is set in the beaker fixing hole of the ultrasonic dispersing unit, and the ultrasonic dispersing unit is operated. Then, the height position of the beaker is adjusted in order that the liquid level of the electrolyte solution in the beaker might resonate with an ultrasonic wave from the ultrasonic dispersing unit to the fullest extent possible.

[5] About 10 mg of toner are gradually added to and dispersed in the electrolyte solution in the beaker in the section [4] in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

[6] The electrolyte solution in the section [5] in which the toner had been dispersed is dropped with a pipette to the round-bottom beaker in the section [1] placed in the sample stand, and the concentration of the toner to be measured is adjusted to about 5%. Then, measurement is performed until the particle diameters of 50,000 particles are measured.

[7] The measurement data is analyzed with the dedicated software included with the apparatus, and the weight-average particle diameter (D4) of the toner is calculated. It should be noted that an "average diameter" on the "analysis/volume statistics (arithmetic average)" screen of the dedicated software when the dedicated software is set to show a graph in a vol % unit is the weight-average particle diameter (D4).

EXAMPLES

Hereinafter, the present invention is described more specifically by way of production examples and examples. It should be noted that all the terms "part(s)" in the examples each represent "part(s) by mass."

<Production of Untreated Magnetic Particles>

An aqueous solution of ferrous sulfate was mixed with 1.0 equivalent of a caustic soda solution with respect to its iron element and 1.5 mass % of soda silicate in terms of a silicon element with respect to the iron element. Thus, an aqueous solution containing ferrous hydroxide was prepared. While the pH of the aqueous solution was kept at 9.0, air was blown into the solution so that an oxidation reaction might be performed at 80° C. or higher and 90° C. or lower. Thus, a slurry liquid in which a seed crystal was to be produced was prepared. Next, an aqueous solution of ferrous sulfate was added to the slurry liquid in an amount of 1.0 equivalent with respect to an alkali amount (the sodium component of caustic soda). After that, the pH of the slurry liquid was kept at 8.0, and an oxidation reaction proceeded while air was blown into the liquid. Thus, a slurry liquid containing magnetic iron oxide was obtained. The slurry was filtrated and washed. After that, the resultant was filtrated again. After that, the resultant was shredded and dried. Thus, untreated magnetic particles were obtained.

<Preparation of Silane Compound 1>

First, 20 parts by mass of isobutyltrimethoxysilane were dropped to 80 parts by mass of ion-exchanged water while the water was stirred. Then the pH and temperature of the aqueous solution were kept at 5.5 and 40° C., respectively, and the solution was subjected to dispersion with a disper blade at 0.46 m/s for 2 hours so that hydrolysis might be performed. Thus, Silane Compound 1 as an aqueous solution containing a hydrolysate was obtained. The physical properties of Silane Compound 1 were measured. As a result, the hydrolysis ratio was 90% and the siloxane ratio was 4%. Table 1 shows the physical properties of Silane Compound 1 thus obtained.

<Preparation of Silane Compounds 2 to 8>

Silane Compounds 2 to 8 were each obtained in the same manner as in the production of Silane Compound 1 except that an alkoxysilane shown in Table 1 was used, and a hydrolysis time and the pH of an aqueous solution were adjusted as shown in Table 1 so that a hydrolysis ratio and a siloxane ratio might take desired values. Table 1 shows the physical properties of Silane Compounds 2 to 8 thus obtained.

<Preparation of Silane Compounds 9 to 11>

Alkoxysilanes which were not subjected to hydrolysis treatments as shown in Table 1 were defined as Silane Compounds 9 to 11. Table 1 shows the physical properties of Silane Compounds 9 to 11.

<Preparation of Silane Compounds 12 to 17>

Silane Compounds 12 to 17 were each obtained in the same manner as in the production of Silane Compound 1 except that an alkoxysilane shown in Table 1 was used; and a hydrolysis time and the pH of an aqueous solution were adjusted so that a hydrolysis ratio and a siloxane ratio might take desired values. Table 1 shows the physical properties of Silane Compounds 12 to 17 thus obtained.

TABLE 1

Physical properties of silane compounds

| Silane compound name | Alkoxysilane | Physical properties of aqueous solution of silane compound: Hydrolysis ratio (%) | Siloxane ratio (%) | Conditions for hydrolysis: Reaction time (minutes) | Temperature (° C.) | pH |
|---|---|---|---|---|---|---|
| Silane Compound 1 | Isobutyltrimethoxysilane | 90 | 4 | 120 | 40 | 5.5 |
| Silane Compound 2 | n-propyltrimethoxysilane | 90 | 4 | 60 | 25 | 4.2 |
| Silane Compound 3 | Isobutyltrimethoxysilane | 90 | 34 | 120 | 48 | 5.5 |
| Silane Compound 4 | Isobutyltrimethoxysilane | 82 | 40 | 110 | 52 | 5.5 |
| Silane Compound 5 | Isobutyltrimethoxysilane | 52 | 28 | 60 | 52 | 5.5 |
| Silane Compound 6 | Isobutyltrimethoxysilane | 48 | 26 | 55 | 52 | 5.5 |
| Silane Compound 7 | Ethyltrimethoxysilane | 48 | 26 | 8 | 20 | 3.3 |
| Silane Compound 8 | Ethyltrimethoxysilane | 30 | 15 | 6 | 20 | 3.3 |
| Silane Compound 9 | Ethyltrimethoxysilane | 0 | 0 | — | — | — |
| Silane Compound 10 | Methyltrimethoxysilane | 0 | 0 | — | — | — |
| Silane Compound 11 | Isobutyltrimethoxysilane | 0 | 0 | — | — | — |
| Silane Compound 12 | n-hexyltrimethoxysilane | 90 | 5 | 180 | 45 | 5.7 |
| Silane Compound 13 | n-hexyltrimethoxysilane | 90 | 36 | 180 | 55 | 5.7 |
| Silane Compound 14 | n-hexyltrimethoxysilane | 48 | 20 | 95 | 57 | 5.7 |
| Silane Compound 15 | n-octyltrimethoxysilane | 90 | 11 | 240 | 50 | 5.9 |
| Silane Compound 16 | n-decyltrimethoxysilane | 90 | 18 | 360 | 59 | 6.1 |
| Silane Compound 17 | n-decyltrimethoxysilane | 90 | 38 | 360 | 67 | 6.1 |

<Production of Treated Magnetic Particles 1>

The untreated magnetic particles was loaded into a Henschel mixer (manufactured by Mitsui Miike Machinery Co., Ltd.). While the magnetic particles was dispersed at 34.5 m/s, Silane Compound 1 was added by spraying. After the dispersion had been continued for 10 minutes, the magnetic particles to which Silane Compound 1 adsorbed was taken out. Then, the treated magnetic particles was left at rest at 160° C. for 2 hours so that the treated magnetic particles might be dried and the condensation reaction of the silane compound might be progressed. After that, the magnetic particles were passed through a sieve having an aperture of 100 μm. Thus, sample of treated magnetic particles 1 was obtained. The physical properties of Treated Magnetic particles 1 were measured. As a result, the moisture adsorption amount was 0.21 $mg/m^2$. Table 2 shows the physical properties of Treated Magnetic particles 1 thus obtained.

<Production of Treated Magnetic Particles 2 to 13>

Treated Magnetic particles 2 to 13 were each obtained in the same manner as in the production of Treated Magnetic particles 1 except that the kind and addition amount of a silane compound were changed as shown in Table 2 in the production of Treated Magnetic particles 1. Table 2 shows the physical properties of Treated Magnetic particles 2 to 13 thus obtained.

<Production of Comparative Treated Magnetic Particles 1>

Comparative Treated Magnetic particles 1 was obtained in the same manner as in the production of Treated Magnetic particles 1 except that the kind and addition amount of a silane compound were changed as shown in Table 2, and the drying temperature and the drying time were set to 180° C. and 6 hours, respectively, in the production of Treated Magnetic particles 1. Table 2 shows the physical properties of Comparative Treated Magnetic particles 1 thus obtained.

<Production of Comparative Treated Magnetic Particles 2>

Comparative Treated Magnetic particles 2 was obtained in the same manner as in the production of Treated Magnetic particles 1 except that the kind and addition amount of a silane compound were changed as shown in Table 2 in the production of Treated Magnetic particles 1. Table 2 shows the physical properties of Comparative Treated Magnetic particles 2 thus obtained.

<Production of Comparative Treated Magnetic Particles 3>

Comparative Treated Magnetic particles 3 was obtained in the same manner as in the production of Treated Magnetic particles 1 except that the kind and addition amount of a silane compound were changed as shown in Table 2, and the drying temperature was set to 120° C. in the production of Treated Magnetic particles 1. Table 2 shows the physical properties of Comparative Treated Magnetic particles 3 thus obtained.

<Production of Comparative Treated Magnetic Particles 4 to 11>

Comparative Treated Magnetic particles 4 to 11 were each obtained in the same manner as in the production of Treated Magnetic particles 1 except that the kind and addition amount of a silane compound were changed as shown in Table 2 in the production of Treated Magnetic particles 1. Table 2 shows the physical properties of Comparative Treated Magnetic particles 4 to 11 thus obtained.

<Production of Comparative Treated Magnetic Particles 12>

In the preparation of untreated magnetic particles, slurry of the magnetic particles is obtained and filtered and washed. A portion of this sample was taken and the water content of the slurry was measured. Subsequently without drying, this slurry was dispersed in water. The pH of the dispersion was adjusted to 6. 0.1 mass part of the silane compound 11, based on 100 mass part of the magnetic particles, was added to this dispersion. Here the mass of the magnetic particles is the mass of the dried sample. Thus silane-coupling treatment was conducted on the magnetic particles. The sample of hydrophobic magnetic particles thus obtained was washed, filtered and dried. The sample was reground to crush slightly aggregated particles in the sample. Thus the sample of Comparative Treated Magnetic particles 12 was obtained. The property of Comparative Treated Magnetic particles 12 was shown in Table 2.

TABLE 2

| Magnetic toner No. | Treated magnetic particles No. | Silane compound No. | Addition amount of silane compound (part(s) by mass) | Moisture adsorption amount ($mg/m^2$) | Styrene elution ratio(%) | Carbon deposit ($g/m^2$) |
|---|---|---|---|---|---|---|
| Magnetic Toner 1 | Treated Magnetic particles 1 | Silane Compound 1 | 3.8 | 0.140 | 15 | 0.08 |
| Magnetic Toner 2 | Treated Magnetic particles 2 | Silane Compound 2 | 4.5 | 0.142 | 12 | 0.08 |
| Magnetic Toner 3 | Treated Magnetic particles 3 | Silane Compound 1 | 2.5 | 0.141 | 11 | 0.052 |
| Magnetic Toner 4 | Treated Magnetic particles 4 | Silane Compound 1 | 4.4 | 0.130 | 14 | 0.094 |
| Magnetic Toner 5 | Treated Magnetic particles 5 | Silane Compound 1 | 5.0 | 0.130 | 15 | 0.105 |
| Magnetic Toner 6 | Treated Magnetic particles 6 | Silane Compound 1 | 2.3 | 0.148 | 10 | 0.048 |
| Magnetic Toner 7 | Treated Magnetic particles 7 | Silane Compound 3 | 5.0 | 0.172 | 16 | 0.106 |
| Magnetic Toner 8 | Treated Magnetic particles 8 | Silane Compound 4 | 5.0 | 0.179 | 17 | 0.106 |
| Magnetic Toner 9 | Treated Magnetic particles 9 | Silane Compound 5 | 5.0 | 0.195 | 20 | 0.104 |
| Magnetic Toner 10 | Treated Magnetic particles 10 | Silane Compound 6 | 5.0 | 0.221 | 22 | 0.103 |
| Magnetic Toner 11 | Treated Magnetic particles 11 | Silane Compound 7 | 8.0 | 0.231 | 22 | 0.107 |
| Magnetic Toner 12 | Treated Magnetic particles 12 | Silane Compound 8 | 12.0 | 0.289 | 25 | 0.105 |
| Magnetic Toner 13 | Treated Magnetic particles 13 | Silane Compound 7 | 3.0 | 0.295 | 22 | 0.04 |
| Comparative Magnetic Toner 1 | Comparative Treated Magnetic particles 1 | Silane Compound 10 | 3.8 | 0.297 | 24 | 0.078 |
| Comparative Magnetic Toner 2 | Comparative Treated Magnetic particles 2 | Silane Compound 9 | 11.3 | 0.298 | 26 | 0.2 |
| Comparative Magnetic Toner 3 | Comparative Treated Magnetic particles 3 | Silane Compound 9 | 7.4 | 0.310 | 24 | 0.1 |
| Comparative Magnetic Toner 4 | Comparative Treated Magnetic particles 4 | Silane Compound 11 | 5.7 | 0.315 | 28 | 0.13 |
| Comparative Magnetic Toner 5 | Comparative Treated Magnetic particles 5 | Silane Compound 11 | 4.3 | 0.320 | 28 | 0.098 |

TABLE 2-continued

| Magnetic toner No. | Treated magnetic particles No. | Silane compound No. | Addition amount of silane compound (part(s) by mass) | Moisture adsorption amount ($mg/m^2$) | Styrene elution ratio(%) | Carbon deposit ($g/m^2$) |
|---|---|---|---|---|---|---|
| Comparative Magnetic Toner 6 | Comparative Treated Magnetic particles 6 | Silane Compound 12 | 1.0 | 0.230 | 25 | 0.026 |
| Comparative Magnetic Toner 7 | Comparative Treated Magnetic particles 7 | Silane Compound 13 | 1.0 | 0.232 | 28 | 0.025 |
| Comparative Magnetic Toner 8 | Comparative Treated Magnetic particles 8 | Silane Compound 14 | 3.2 | 0.260 | 31 | 0.09 |
| Comparative Magnetic Toner 9 | Comparative Treated Magnetic particles 9 | Silane Compound 15 | 0.9 | 0.230 | 23 | 0.027 |
| Comparative Magnetic Toner 10 | Comparative Treated Magnetic particles 10 | Silane Compound 16 | 0.8 | 0.220 | 23 | 0.026 |
| Comparative Magnetic Toner 11 | Comparative Treated Magnetic particles 11 | Silane Compound 17 | 0.5 | 0.254 | 28 | 0.016 |
| Comparative Magnetic Toner 12 | Comparative Treated Magnetic particles 12 | Silane Compound 11 | 1.0 | 0.320 | 28 | 0.02 |

<Production of Magnetic Toner 1>

After 450 parts by mass of a 0.1M-$Na_3PO_4$ solution were loaded into 720 parts by mass of ion exchanged water, followed by heating to 60° C., 67.7 parts by mass of a 1.0 M-$CaCl_2$ solution were added, to thereby obtain an aqueous medium containing a dispersion stabilizer.

| | |
|---|---|
| Styrene: | 76.00 parts by mass |
| n-butyl acrylate: | 24.00 parts by mass |
| Divinylbenzene: | 0.52 part by mass |
| Monoazo dye iron complex (T-77: manufactured by Hodogaya Chemical Co., Ltd.): | 1.00 part by mass |
| Treated Magnetic particles 1: | 90.00 parts by mass |
| Amorphous polyester: | 3.00 parts by mass |

(Saturated polyester resin obtained by a condensation reaction between an ethylene oxide adduct of bisphenol A and terephthalic acid: Mn=5000, acid value=12 mgKOH/g, Tg=68° C.)

The above components were uniformly dispersed and mixed with an Attritor (manufactured by Mitsui Miike Machinery Co., Ltd.). Thus, a monomer composition was obtained. The monomer composition was heated to 60° C., and 15.0 parts by mass of a paraffin wax (having an endothermic peak top temperature of 77.2° C.) were mixed and dissolved in the composition. After that, 4.5 parts by mass of 2,2'-azobis(2,4-dimethylvaleronitrile) as a polymerization initiator were dissolved in the mixture.

The above monomer composition was loaded into the above aqueous medium, and the mixture was stirred at 60° C. under an $N_2$ atmosphere with a TK-homomixer (manufactured by Tokushu Kika Kogyo) at 18.8 m/s for 10 minutes so that suspended droplet might be formed. Then, the temperature of the mixture was increased to 70° C. at a rate of 0.5° C./min while the mixture was stirred with a paddle stirring blade. The mixture was subjected to a reaction for 5 hours while its temperature was kept at 70° C. Subsequently, the temperature was increased to 90° C. and maintained for 2 hours. Then temperature was gradually cooled down to 30° C. at a rate of 0.5° C./min. After the temperature was cooled, hydrochloric acid was added to wash the product. Finally the washed product was filtrated and dried. Thus, the sample of Magnetic Toner Particles 1 was obtained.

Then, 100 parts by mass of Magnetic Toner Particles 1 and 1.0 part by mass of a hydrophobic silica fine powder having a number-average primary particle diameter of 12 nm were mixed with a Henschel mixer (manufactured by Mitsui Miike Machinery Co., Ltd.). Thus, Magnetic Toner 1 having a weight-average particle diameter (D4) of 7.0 μm was obtained. The resultant magnetic toner was analyzed. As a result, the toner contained 100 parts by mass of a binder resin.

<Production of Magnetic Toners 2 to 13>

Magnetic Toners 2 to 13 were each obtained in the same manner as in the production of Magnetic Toner 1 except that any one of Treated Magnetic particles 2 to 13 was used instead of Treated Magnetic particles 1 in the production of Magnetic Toner 1. Those magnetic toners were analyzed. As a result, the toners each contained 100 parts by mass of a binder resin.

<Production of Comparative Magnetic Toners 1 to 12>

Comparative Magnetic Toners 1 to 12 were each obtained in the same manner as in the production of Magnetic Toner 1 except that any one of Comparative Treated Magnetic particles 1 to 12 was used instead of Treated Magnetic particles 1 in the production of Magnetic Toner 1. Those magnetic toners were analyzed. As a result, the toners each contained 100 parts by mass of a binder resin.

Example 1

1. Durable Developing Performance Test

An LBP3000 (manufactured by Canon Inc.) was used as an image-forming apparatus and Magnetic Toner 1 was used as toner. A durability test was performed by printing horizontal line images each having a print percentage of 4% on 2000 sheets according to a continuous mode under each of a normal-temperature, normal-humidity environment (23° C./60% RH) and a high-temperature and high-humidity environment (32.5° C./80% RH). It should be noted that A4 paper having a basis weight of 75 g/m$^2$ was used as a recording medium. One chart in which a solid image portion was formed on the entire surface of printing paper was output at each of a time point before the performance of the durability test and a time point after the performance of the durability test. The solid image was subjected to measurement with a reflection densitometer, i.e., a Macbeth Densitometer (manufactured by Macbeth Co.) using an SPI filter. A chart having an image ratio of 5% was used as an original. Evaluation was performed from two viewpoints, i.e., a reflection density at the initial stage of duration, and a difference between a density before the durability test and a density after the durability test.

[Evaluation Criteria for Initial Density]

Rank A: The reflection density before the durability test is 1.55 or more.

Rank B: The reflection density before the durability test is 1.50 or more and less than 1.55.

Rank C: The reflection density before the durability test is 1.45 or more and less than 1.50.

Rank D: The reflection density before the durability test is 1.35 or more and less than 1.45.

Rank E: The reflection density before the durability test is less than 1.35.

[Evaluation Criteria for Difference Between Density Before Durability Test and Density After Durability Test]

Rank A: The difference between the density before the durability test and the density after the durability test is less than 0.03.

Rank B: The difference between the density before the durability test and the density after the durability test is 0.03 or more and less than 0.10.

Rank C: The difference between the density before the durability test and the density after the durability test is 0.10 or more and less than 0.25.

Rank D: The difference between the density before the durability test and the density after the durability test is 0.25 or more.

A white image was output at each of the time point before the performance of the durability test and the time point after the performance of the durability test, and its reflectivity was measured with a REFLECTMETER MODEL TC-6DS manufactured by Tokyo Denshoku CO., LTD. Meanwhile, the reflectivity of transfer paper (standard paper) before the formation of the white image was similarly measured. A green filter was used as a filter, and fogging was calculated from the following equation.

$$\text{Fogging(reflectivity)(\%)} = \text{reflectivity of standard paper (\%)} - \text{reflectivity of white image sample(\%)}$$

It should be noted that the fogging was evaluated on the basis of the following judgement criteria by using the maximum of the resultant fogging.

[Evaluation Criteria for Fogging]

Rank A: The fogging is less than 0.5%.

Rank B: The fogging is 0.5% or more and less than 1.5%.

Rank C: The fogging is 1.5% or more and less than 3.0%.

Rank D: The fogging is 3.0% or more.

2. Cleaning Performance Test

A cleaning performance test was performed under a low-temperature environment (0° C./about 15% RH). Under the low-temperature environment, a cleaning blade becomes hard and a situation where it is hard to stably scrape the surface of a latent image-bearing member is established. The low-temperature environment becomes a particularly severe evaluation environment when image output is performed according to an intermittent mode after the cleaning blade has been sufficiently cooled because a large torque is applied to the blade.

Magnetic Toner 1 was left to stand under the low-temperature environment for 24 hours, and then horizontal lines each having a print percentage of 4% were printed on 100 sheets with an LBP3000 (manufactured by Canon Inc.) according to an intermittent mode of 7 seconds/sheet. The resultant horizontal line images were visually evaluated, and cleaning performance was judged on the basis of the following criteria. It should be noted that, when a cleaning failure occurs, the toner that has escaped remains on an image-bearing member to prevent the portion where the toner remains from being charged, and hence a black stripe is observed in a print image.

Rank A: No prints show the occurrence of black stripes.

Rank B: Of the prints, 10 or less prints show the occurrence of a slight black stripe.

Rank C: Of the prints, 11 or more prints show the occurrence of a slight black stripe.

Rank D: Of the prints, 11 or more sheets show the occurrence of a slight black stripe, and some prints show the occurrence of an denser black stripe.

Such evaluations as described above were conducted on Magnetic Toner 1. Table 3 shows the results of the evaluations.

Examples 2 to 13

A durable developing performance test and a cleaning performance test were performed in the same manner as in Example 1 except that any one of Magnetic Toners 2 to 13 was used instead of Magnetic Toner 1. Table 3 shows the results of the evaluations.

Comparative Examples 1 to 12

A durable developing performance test and a cleaning performance test were performed in the same manner as in Example 1 except that any one of Comparative Magnetic Toners 1 to 12 was used instead of Magnetic Toner 1. Table 3 shows the results of the evaluations.

TABLE 3

| | Durable developing performance | | | | | |
|---|---|---|---|---|---|---|
| | Normal temperature and normal humidity | | High temperature and high humidity | | | |
| Example No. | Initial image density | Difference between density before duration and density after duration | Initial image density | Difference between density before duration and density after duration | Fogging | Cleaning performance |
| Example 1 | A(1.57) | A(0.01) | A(1.57) | A(0.02) | A(0.2) | A |
| Example 2 | A(1.57) | A(0.01) | A(1.57) | A(0.02) | B(1.0) | A |
| Example 3 | A(1.56) | A(0.01) | B(1.54) | A(0.02) | A(0.2) | A |
| Example 4 | A(1.57) | A(0.01) | A(1.56) | A(0.02) | A(0.2) | A |
| Example 5 | A(1.57) | A(0.01) | A(1.56) | B(0.03) | A(0.2) | B |
| Example 6 | A(1.55) | A(0.01) | C(1.48) | B(0.04) | A(0.2) | A |
| Example 7 | A(1.56) | A(0.01) | B(1.53) | B(0.05) | A(0.3) | B |
| Example 8 | B(1.53) | A(0.01) | C(1.48) | B(0.06) | B(1.1) | B |
| Example 9 | A(1.55) | A(0.02) | C(1.47) | B(0.05) | B(1.1) | B |
| Example 10 | B(1.51) | B(0.04) | C(1.46) | C(0.15) | B(1.1) | B |
| Example 11 | B(1.51) | B(0.05) | C(1.45) | C(0.15) | C(2.1) | C |
| Example 12 | B(1.50) | B(0.05) | D(1.42) | C(0.17) | C(2.1) | C |
| Example 13 | D(1.38) | B(0.05) | D(1.40) | C(0.19) | C(2.5) | C |
| Comparative Example 1 | D(1.35) | B(0.08) | E(1.3) | C(0.24) | C(2.9) | D |
| Comparative Example 2 | D(1.35) | C(0.23) | E(1.31) | D(0.32) | B(1.3) | C |
| Comparative Example 3 | D(1.35) | C(0.22) | E(1.30) | D(0.33) | B(1.3) | C |
| Comparative Example 4 | E(1.30) | C(0.22) | E(1.31) | D(0.35) | B(1.4) | C |
| Comparative Example 5 | E(1.33) | C(0.23) | E(1.30) | D(0.35) | B(1.4) | D |
| Comparative Example 6 | C(1.47) | B(0.05) | D(1.38) | C (0.23) | C(2.2) | D |
| Comparative Example 7 | D(1.35) | B(0.06) | E(1.34) | C(0.23) | C(2.5) | D |
| Comparative Example 8 | D(1.36) | C(0.15) | E(1.30) | D(0.30) | D(3.7) | D |
| Comparative Example 9 | D(1.36) | B(0.08) | D(1.36) | C(0.15) | C(2.2) | D |
| Comparative Example 10 | D(1.36) | B(0.09) | D(1.36) | C(0.2) | C(2.3) | D |
| Comparative Example 11 | D(1.35) | C(0.24) | E(1.32) | D(0.33) | D(3.9) | D |
| Comparative Example 12 | E(1.28) | C(0.22) | E(1.30) | D(0.31) | B(1.4) | C |

While the present invention has been described with reference to exemplary embodiments, it is to be understood that the invention is not limited to the disclosed exemplary embodiments. The scope of following claims is to be accorded the broadest interpretation so as to encompass all such modifications and equivalent structures and functions.

These application claims the benefit of Japanese Patent Application No. 2009-99253, filed Apr. 15, 2009, which is hereby incorporated by reference herein its entirety.

What is claimed is:

1. A magnetic toner, comprising:

magnetic toner particles, each of which comprises a binder resin and treated magnetic particles; and an inorganic fine powder, wherein:

the treated magnetic particles have been surface-treated with a silane compound;

the silane compound has a hydrocarbon group having 2 to 4 carbon atoms;

the treated magnetic particles have a moisture adsorption amount per unit area based on a BET specific surface area of 0.300 mg/m$^2$ or less; and the amount of extract which is extracted from the treated magnetic particles by a styrene constitutes 25 mass % or less in a total amount of the silane compound contained in the treated magnetic particles.

2. A magnetic toner according to claim 1, wherein the silane compound comprises a treated product obtained by subjecting an alkoxysilane to a hydrolysis treatment.

3. A magnetic toner according to claim 2, wherein the treated product obtained by subjecting the alkoxysilane to the hydrolysis treatment has a hydrolysis ratio of 50% or more.

4. A magnetic toner according to claim 2, wherein a hydrolysate present as a siloxane accounts for 35% or less of the treated product obtained by subjecting the alkoxysilane to the hydrolysis treatment.

5. The magnetic toner according to claim 2, wherein the alkoxysilane is an alkylalkoxysilane.

6. A magnetic toner according to claim 1, wherein the treated magnetic particles have a carbon amount per unit area based on a BET specific surface area of 0.050 g/m$^2$ or more and 0.100 g/m$^2$ or less.

7. A magnetic toner according to claim 1, wherein the magnetic toner particles are produced in an aqueous medium.

8. A magnetic toner according to claim 7, wherein the magnetic toner particles are produced by a suspension polymerization method.

9. The magnetic toner according to claim 1, wherein the treated magnetic particles have been surface-treated in a vapor phase.

* * * * *